US005520562A

United States Patent [19]

Eddy

[11] Patent Number: 5,520,562

[45] Date of Patent: May 28, 1996

[54] WAVE SUPPRESSOR

[76] Inventor: Roger C. Eddy, 3101 Fernwood La., New Castle, Pa. 16105

[21] Appl. No.: 362,820

[22] Filed: Dec. 22, 1994

[51] Int. Cl.[6] ..... B63B 22/00

[52] U.S. Cl. ..... 441/133; 4/497

[58] Field of Search ..... 441/133, 6; 4/497

[56] References Cited

U.S. PATENT DOCUMENTS

| | | | |
|---|---|---|---|
| 4,048,677 | 9/1977 | Kajlich | 441/133 |
| 4,052,755 | 10/1977 | Baker | 441/133 |
| 4,894,873 | 1/1990 | Kiefer et al. | 441/133 |

*Primary Examiner*—Jesus D. Sotelo
*Attorney, Agent, or Firm*—Titus & McConomy

[57] ABSTRACT

A swimming lane wave suppressor, for use in suppressing waves and for use in the demarcation of swimming pool lanes, comprised of two cylindrical cores having a plurality of fins radially extending from their outer surface, the inner surface of the first core having a larger diameter than the inner surface of the second core. The fins are positioned substantially coextensively in a lane of each core. At least one spacer is circumferentially positioned between and connected to the core members and fins. A flotation assembly is axially positioned within the first core member having the larger inside diameter and compression fit against the inner surface thereof. The flotation assembly includes a hollow, water tight cylindrical body having a central axial opening for receiving a cable or like device for stringing a plurality of wave suppressors together to form a lane demarcation.

6 Claims, 6 Drawing Sheets

WAVE SUPPRESSOR

FIELD OF THE INVENTION

The present invention relates to an improved swimming lane design which suppresses waves and can be more easily wound around a storage reel in comparison to existing designs.

BACKGROUND OF THE INVENTION

The use of wave suppressors is generally well known. For example in U.S. Pat. No. 3,304,560 a turbulence reducing device is shown in which a plurality of lattice devices are strung the length of the swimming pool. Float means are attached to the ends of each of the devices to maintain buoyancy if the device is formed of a non-buoyant material. This suppressor was one of the earliest attempts to suppress wave transmission between swimming lanes.

Numerous other devices have also been proposed to better suppress turbulence in competitive swimming pools, e.g. U.S. Pat. Nos. 3,540,063; 3,755,829; 3,786,521; 4,048,677 and 4,052,755. In general, these "racing lanes" consist of a plurality of elements strung on a cable that extends the length of the pool to define the boundaries of the swimming lanes. Each element is configured as a particular axially symmetric shape designed to suppress or inhibit the propagation of waves generated by a swimmer into the lane of another swimmer. Of these, U.S. Pat. No. 3,755,829 has found commercial success in the marketplace.

Another such device of particular interest is disclosed in U.S. Pat. No. 3,886,602. The device disclosed has a plurality of discs positioned perpendicular to the cable and is manufactured from a foamed plastic so that each element is capable of floating without separate flotation means. This device overcame many of the objections of the prior art devices which do little more than mark the lanes. However, because of its size and shape it permitted the majority of waves energy to pass from one pool lane to another. Additionally, it was difficult to handle and store and expensive to manufacture.

U.S. Pat. No. 4,894,873 discloses a wave suppression device comprised of a cylindrical core having a plurality of fins radially extending from its outer surface. The fins create enclosures which trap water motion, thus creating random turbulent motion which dissipates the viscous forces of water. This device includes a central channel for receiving an integral flotation means, with this flotation means, in turn, having a central channel for receiving a cable-like device for stringing a plurality of wave suppression devices together to form a lane demarcation. In the preferred embodiment of this wave suppression device, the integral flotation means is comprised of two flotation elements formed by blow molding techniques or by injection molding. The two integral flotation elements are compression fit within the core immediately after molding. While this devise improved upon wave suppressors in the marketplace, such assembly can be cumbersome and difficult to place on a storage reel without allowance for additional cable because of spacing which occurs between flotation elements.

Accordingly, it is the object of the present invention to provide an improved swimming lane designed which utilizes the wave suppression theory of this most recent wave suppression device of provides for a flotation means which is more easily assembled. In addition, the swimming lane wave suppressor of the present invention allows the swimming lane to be tightly wound around a storage wheel without the requirements of additional cable which exist in current designs.

SUMMARY OF THE INVENTION

In general, the present invention provides a wave suppressor which is comprised of two cylindrical cores having a plurality of fins radiating therefrom and which extend substantially the length of each core. The inside diameter of the first core is greater than the inside diameter of the second. At least one spacer member or disk is located between the cores and interconnects with and supports the fins. The combination of fins and spacer defined wave entrapment cavities. Coextensively within the second core, which has the smaller inside diameter, is a central axial opening for placing a cable or other securing means on which a plurality of wave suppressors may be strung. In the preferred embodiment, an integral flotation means is compression fit within the first core having the larger inside diameter. This flotation means also has a central axial opening which is coextensive with a central opening in the second core. The opening in the first core and within the flotation means work together to permit the wave suppressor to be mounted on a cable coextensively positioned through the wave suppressor. In a preferred embodiment, the flotation means contains sufficient air to provide buoyancy to the wave suppressor such that when a plurality of such elements are strung on a cable, the wave suppressors are half submerged.

In a preferred embodiment, the wave suppressor is formed from injection molded polymer. The flotation means is preferably formed by blow molding techniques so as to provide an air tight seal to a hollow interior.

In contrast to pre-existing wave suppression means, the flotation means can be more easily inserted in the wave suppressor. In addition, the wave suppressor of the present invention is designed such that it maintains contact with other wave suppressors mounted coextensively on a cable such that when a swimming lane comprising a plurality of wave suppressors mounted on a cable is wound onto a storage reel, the wave suppressors continue to maintain contact and additional cable is not needed to allow for such storage. Other advantages of the invention will become apparent from a perusal of the following detailed description of a presently preferred embodiment of the invention.

PRESENTLY PREFERRED EMBODIMENT OF THE INVENTION

Figure 1:
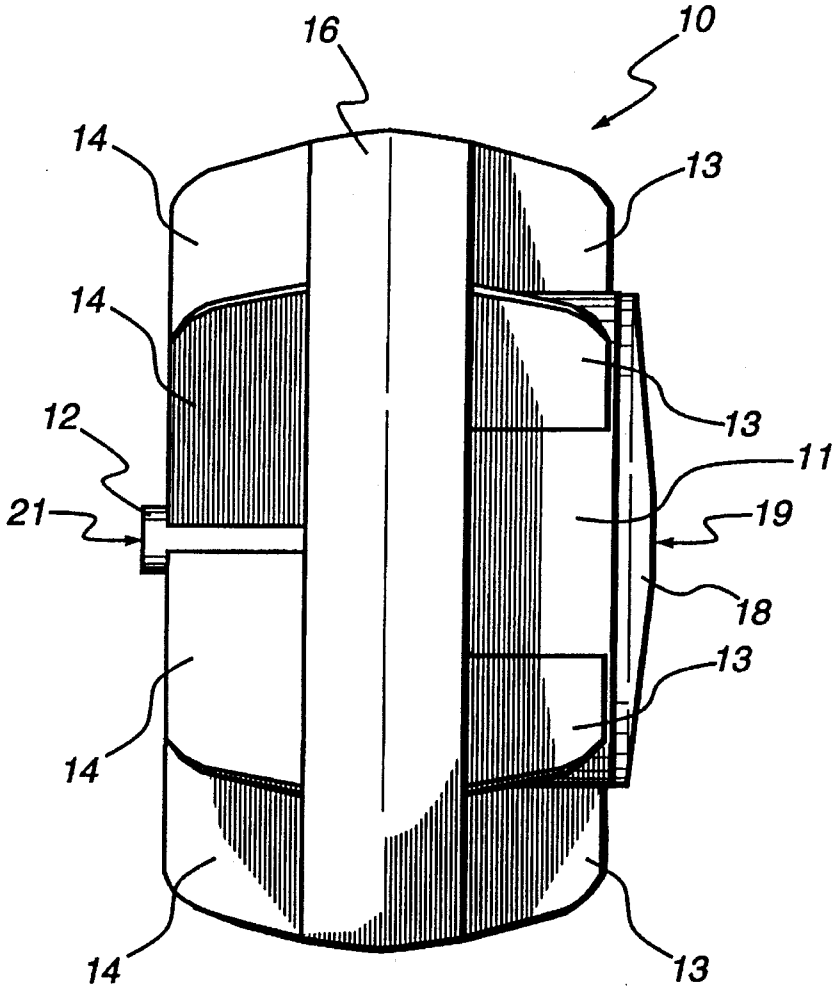
FIG. 1 is side elevation of the swimming lane wave suppressor of the present invention.
Figure 3:
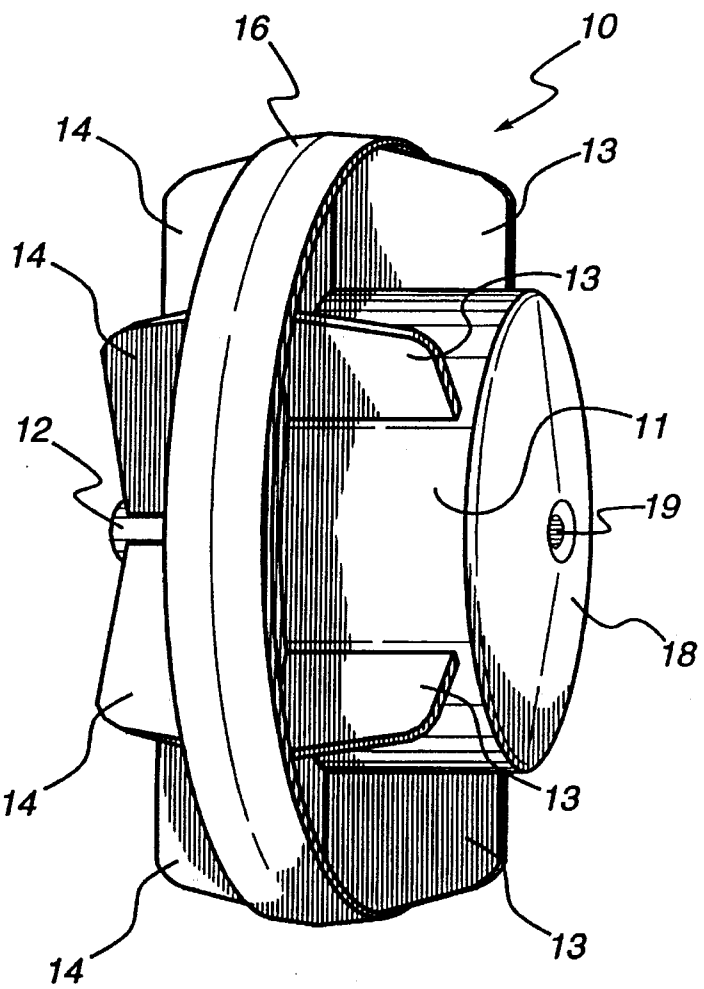
FIG. 3 is a perspective view of the wave suppressor shown in FIG. 1.
Figure 2:
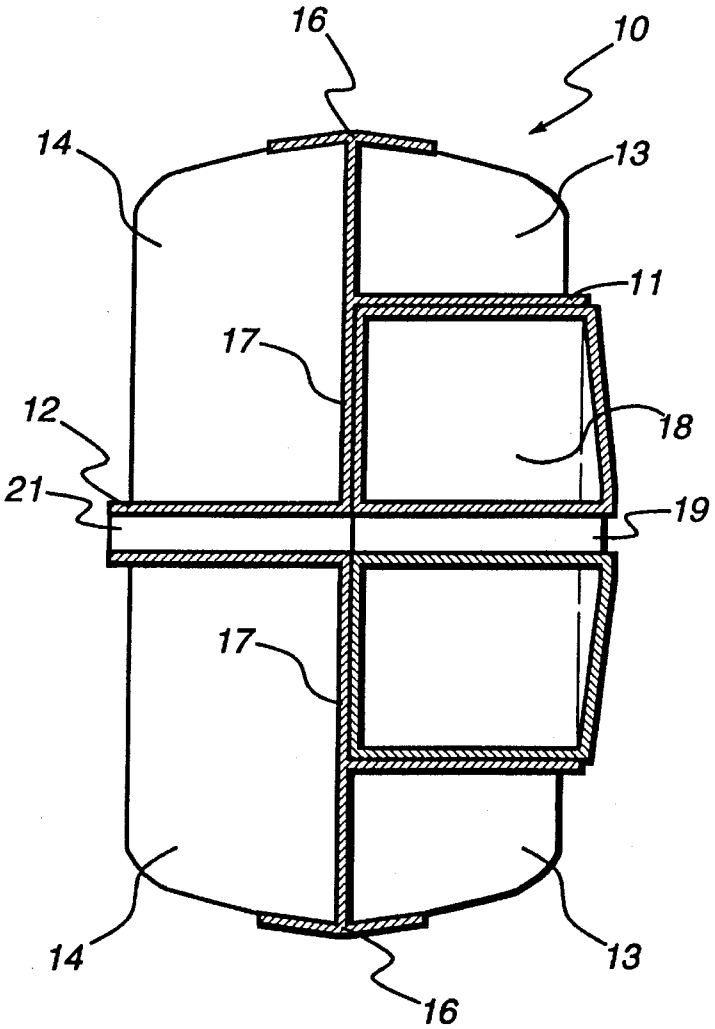
FIG. 2 is a cut-away side elevation of the wave suppressor shown in FIG. 1.
Figure 5:
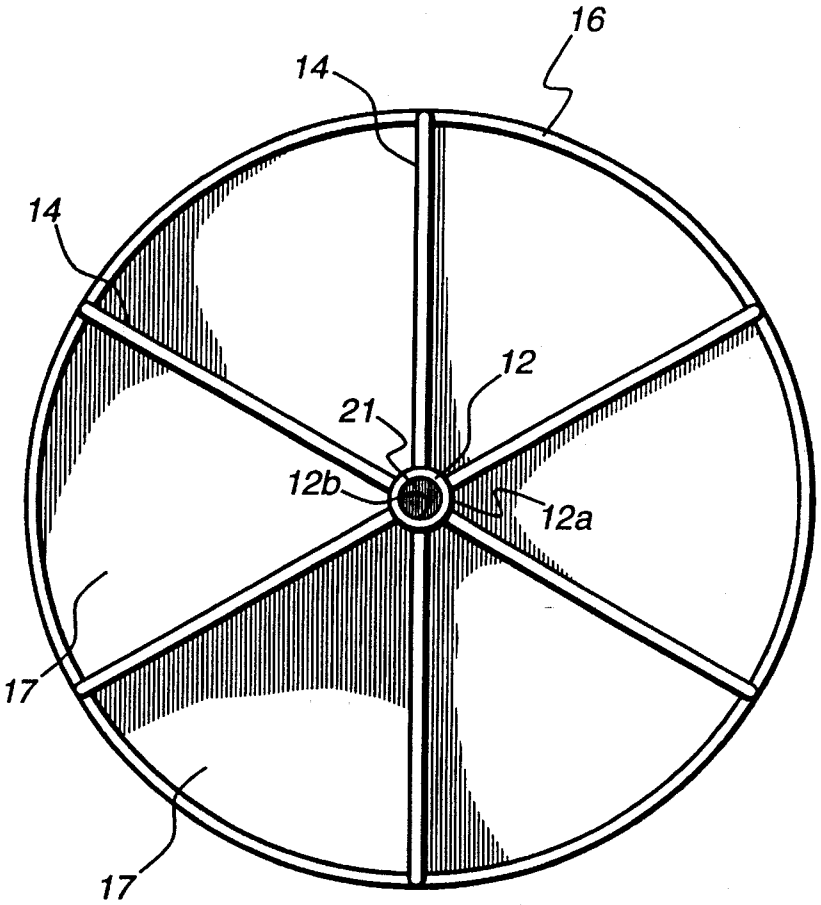
FIG. 5 is an end view of the wave suppressor shown in FIG. 1, opposite to the end view of FIG. 4.
Figure 4:
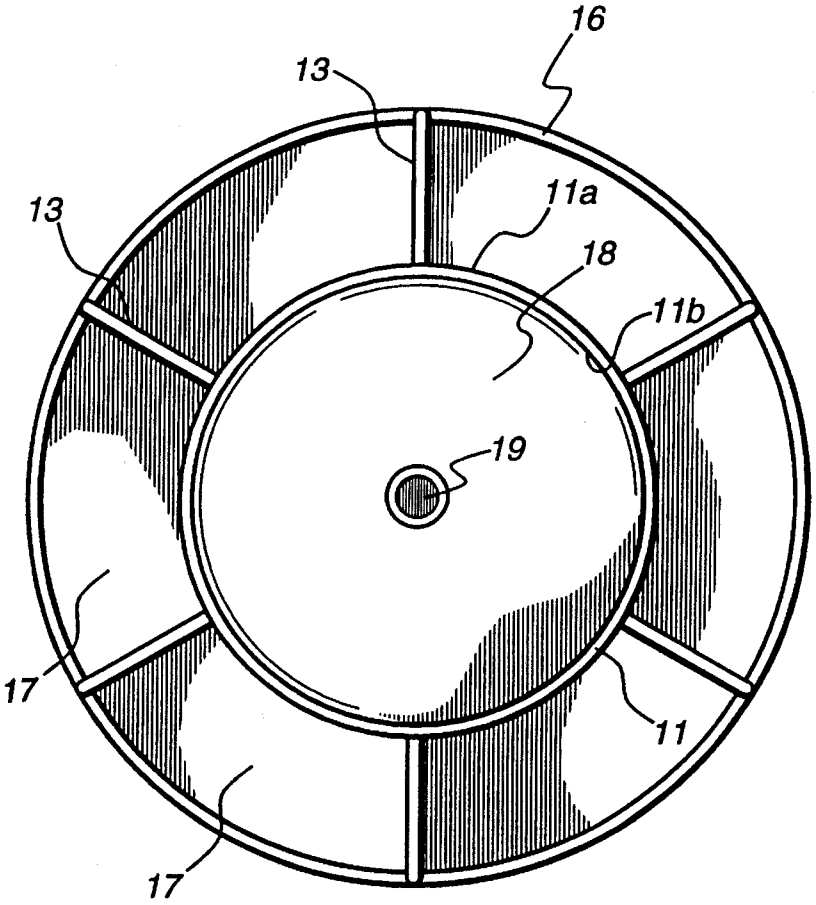
FIG. 4 is an end view of the wave suppressor shown in FIG. 1.

Referring to FIGS. 1–5, swimming lane wave suppressor 10 of the present invention comprises two cylindrical cores 11 and 12, with cylindrical core 11 having a larger diameter than cylindrical core 12. Core 11 includes a plurality of radially extending fins 13 extending from outer surface 11*a*. Core 12 similarly includes a plurality of radially extending fins 14, which extend outward from surface 12*a*. Spacer member 17 is positioned perpendicular to and circumferentially between cores 11 and 12 to define a plurality of wave entrapment cavities. Spacer member 17 includes a peripheral flange 16. In a preferred embodiment, flange 16 has an outer diameter greater than the outer diameter of fins 13 and 14 thereby providing protection to fins 13 and 14 when a plurality of wave suppressors are wound on a storage wheel.

Spacer member 17 provides support to fins 13 and 14 in their relative positions as well as imparting wave deflection and entrapment as waves impact the fins and core of wave suppressor 10. In the presently preferred embodiment, it has been found necessary to utilize only one such spacer member between cores 11 and 12. As shown, this member is positioned midway between identical lengths of cores 11 and 12 so as to bifurcate the float into two segments. However, more than one spacer may be useful for large waves suppressor elements and for more effective entrapment of circular wave patterns.

Inner surface 11*b* of core 11 forms a cylindrical channel into which float member 18 is inserted. Float number 18, in turn, has a cylindrical channel 19 which is designed to receive a cable for purposes of stringing plurality of wave suppressor 10 together.

Inner surface 12*b* of core 12 similarly defines a channel 21, which is positioned to correspond to the location of channel 19 and, together with channel 19, form a co-extensive channel through wave suppressor 10 for purposes of receiving a cable.

Figure 7:
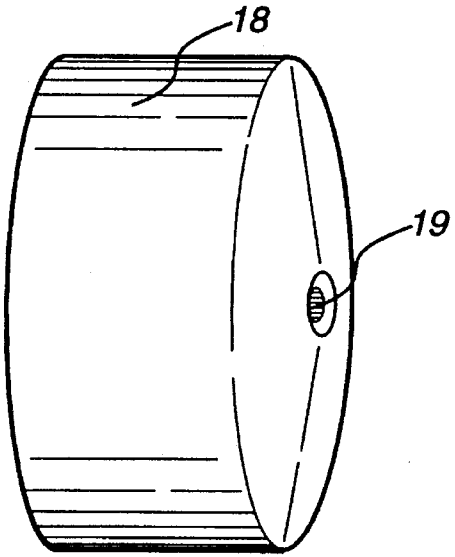
FIG. 7 is a perspective view of the flotation member.
Figure 6:
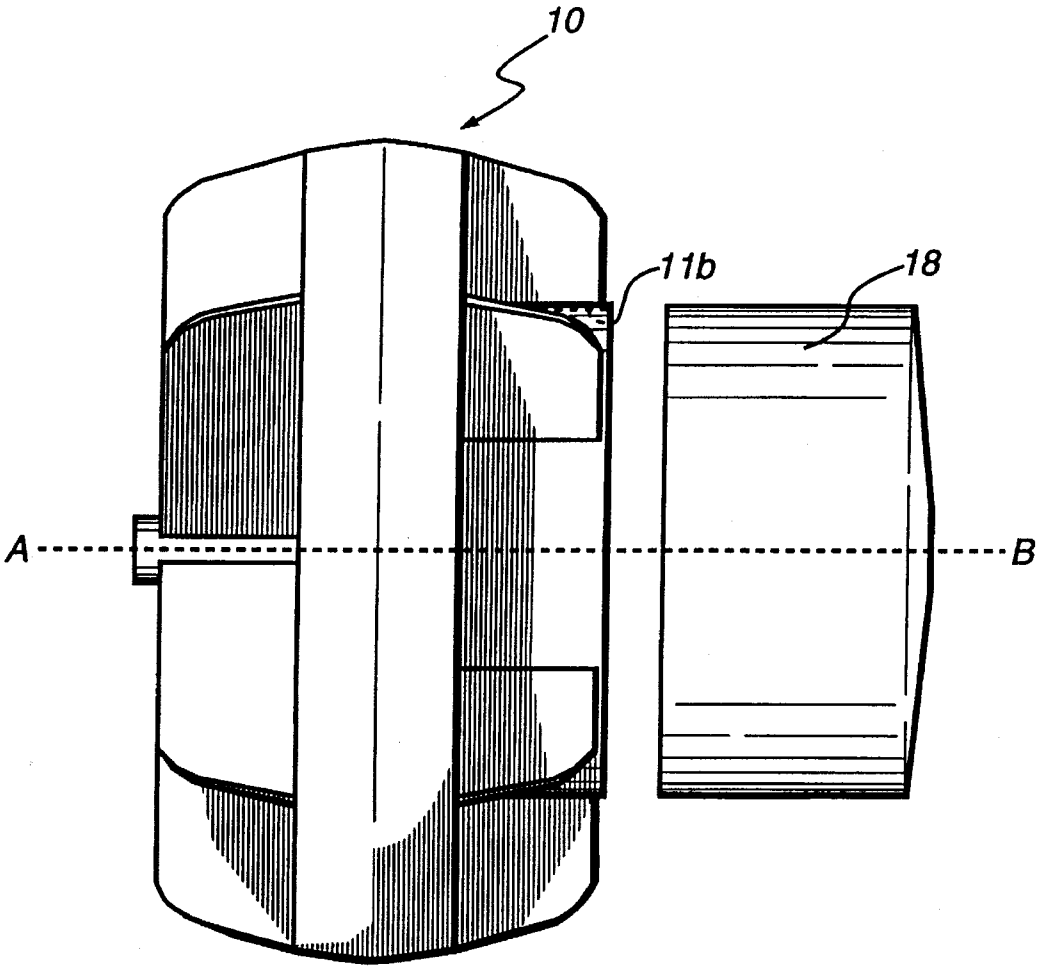
FIG. 6 is a side elevation of the wave suppressor and flotation means prior to insertion of the flotation means into the wave suppressor.

With reference to FIGS. 6 and 7, float member 18 comprises a hollow, cylindrical body having channel 19 integrally formed therein. In a preferred embodiment, float number 18 is formed either by blow molding techniques or by injection molding such that the interior thereof is water tight. Float member 18 is compression fit within the inner wall 11*b* of core 11 element. The air contained in float number 18 is sufficient to support wave suppressor 10 within the water along line A-B of FIG. 6. Stated differently, in the preferred embodiment, wave suppressor 10 is approximately 50% submerged so that it can effectively dissipate wave motion above and below the water line.

Figure 8:
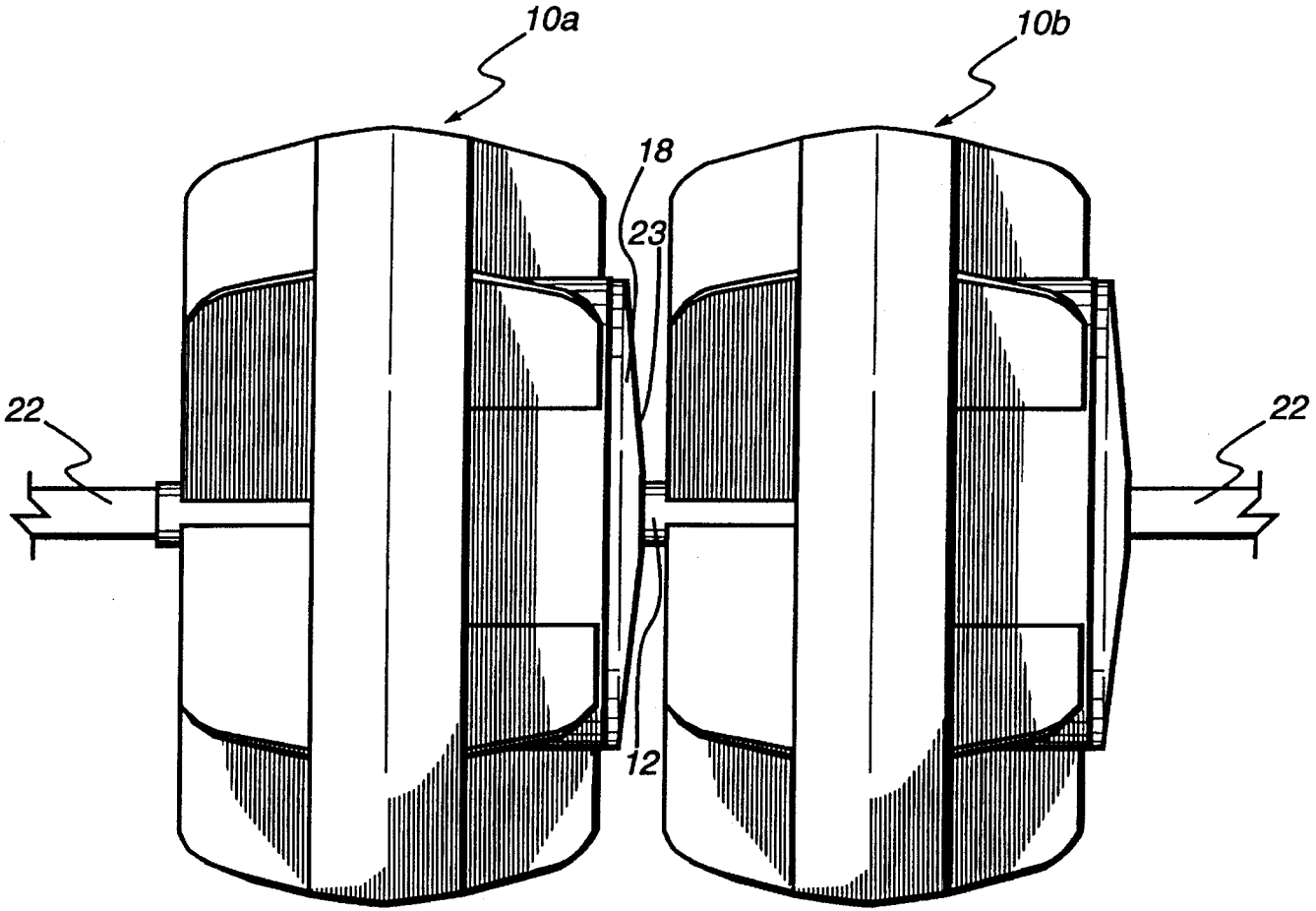
FIG. 8 is a side elevation of two wave suppressors of the invention as strung on a cable.
Figure 9:
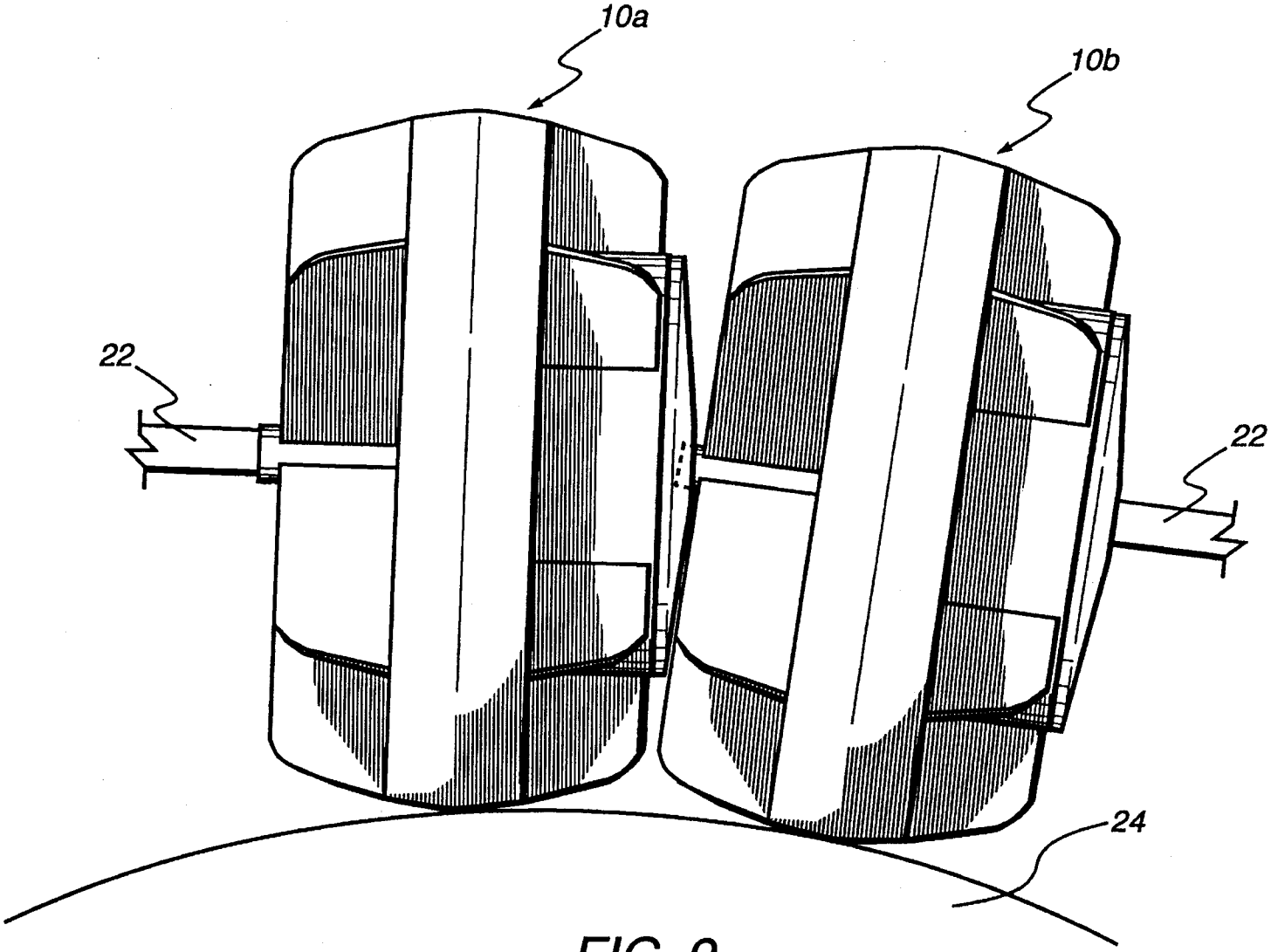
FIG. 9 is a side elevation of the two wave suppressors shown in FIG. 8 as wound around a storage reel.

Referring to FIGS. 8 and 9, two wave suppressors 10*a* and 10*b* are depicted as strung on cable 22. In actual use, a plurality of additional wave suppressors would also be strung on cable 22 to form a swimming lane. Two wave suppressors 10*a* and 10*b* are depicted in FIGS. 8 and 9 to show the manner in which they interact when strung on cable 22.

More specifically, when wave suppressors 10*a* and 10*b* are strung on cable 22, core 12 of wave suppressor 10*b* directly contacts float member 18 at the point where float number 18 forms channel 19. In a preferred embodiment, outer surface 23 of float member 18 slopes outward from wave suppressor 10 to the point of contact between float member 18 and core 12.

As depicted in FIG. 9, when cable 22 is wound around storage reel 24, wave suppressors 10(*a*) and 10(*b*) remain in contact. By comparison, current float devices have a tendency to separate when the cable on which they are strung is wound around a storage wheel. As a result, additional cable is needed in order to allow for such separation.

In the presently preferred embodiment of the invention, it is preferred that each wave suppressor 10 be injection molded polymer. Various diameters tend to utilized, with a diameter of 4 to 5 inches being most effective for use in swimming lanes.

While the presently preferred embodiment of the invention has been shown and described in particularity, the invention may be otherwise embodied within the scope of the following claims.

What is claimed is:

1. A swimming lane wave suppressor means comprised of a. a first cylindrical core member having an inner and outer surface and interior and exterior ends and including a plurality of fins radially extending from the outer surface of said first core member and positioned substantially coextensively along the length of said first core member;

b. a second cylindrical core member having an inner and outer surface and interior and exterior ends, the inner surface of said second cylindrical core member having a diameter less than that formed by the inner surface of said first cylindrical core member, and said second cylindrical core member further including a plurality of fins radially extending from the outer surface of said second core member and positioned substantially coextensively along the length of said second core member to the outer surface at the exterior end of said second core member;

c. at least one spacer member circumferentially positioned between and connected to the interior ends of said first and second core members and said fins; and d. a flotation means, having interior and exterior ends, axially positioned within said first core member and compression fit against the inner surface of said first core member, said flotation means including a central axial opening corresponding to the axial location of said second core member for receiving a means for stringing a plurality of wave suppressors together to form a swimming lane demarcation.

2. A wave suppressor as set forth in claim 1, wherein said wave suppressor includes at least six fins.

3. A wave suppressor as set forth in claim 1 or 2, wherein said flotation means is comprised of a hollow, water tight, cylindrical body having an annular axial channel for forming a central opening there through.

4. A wave suppressor as set forth in claim 1 or 2 wherein said first and second core members have substantially equal lengths.

5. A wave suppressor as set forth in claim 1 or 2 wherein said first and second core members have substantially equal lengths.

6. The wave suppressor as set forth in claim 1 wherein the exterior end of said flotation means slopes circumferentially outward toward the central axial opening therein, with the central axial opening at the exterior end of said flotation means, in conjunction with the outwardly sloping surface of the exterior end of said flotation means, operable to receive and maintain contact with the exterior end of the second cylindrical core member of an adjacent wave suppressor, as strung together, while said wave suppressors are wound around a storage wheel.

* * * * *

UNITED STATES PATENT AND TRADEMARK OFFICE

CERTIFICATE OF CORRECTION

PATENT NO. : 5,520,562

DATED : May 28, 1996

INVENTOR(S) : Roger C. Eddy

It is certified that error appears in the above-indentified patent and that said Letters Patent is hereby corrected as shown below:

In Column 4, lines 52-54, substitute the following:

"5. A wave suppressor as set forth in Claim 1 or 2 wherein said first and second core members have substantially equai lengths."

with:

"5. A wave suppressor as set forth in Claims 1 or 2, wherein said spacer member includes a circumferential flange having an outer diameter slightly greater than the outer diameter of said fins."

Signed and Sealed this

Tenth Day of June, 1997

*Attest:*

*Attesting Officer*

Bruce Lehman

BRUCE LEHMAN

*Commissioner of Patents and Trademarks*